US007918710B2

(12) United States Patent
Bapst et al.

(10) Patent No.: US 7,918,710 B2
(45) **Date of Patent: *Apr. 5, 2011**

(54) ROTATABLE ENTERTAINMENT DEVICE

(75) Inventors: David M. Bapst, South Wales, NY (US); Maarten Van Huystee, East Aurora, NY (US); John F. Rhein, Hamburg, NY (US); Robert J. Sonner, South Wales, NY (US)

(73) Assignee: Mattel, Inc., El Segundo, CA (US)

( * ) Notice: Subject to any disclaimer, the term of this patent is extended or adjusted under 35 U.S.C. 154(b) by 699 days.

This patent is subject to a terminal disclaimer.

(21) Appl. No.: 11/769,052

(22) Filed: Jun. 27, 2007

(65) Prior Publication Data

US 2007/0249260 A1 Oct. 25, 2007

Related U.S. Application Data

(63) Continuation of application No. 10/691,663, filed on Oct. 24, 2003, now Pat. No. 7,247,078.

(60) Provisional application No. 60/466,737, filed on May 1, 2003.

(51) Int. Cl.
*A63H 33/00* (2006.01)

(52) U.S. Cl. ..... 446/227; D21/465; D21/476; D6/344; D6/334

(58) Field of Classification Search ..... 446/273, 446/266, 236, 351, 322, 244, 258, 227; 434/292, 434/291, 293, 290; 40/446, 484; D11/141; D21/467, 412, 453; D6/334
See application file for complete search history.

(56) References Cited

U.S. PATENT DOCUMENTS

| | | | | |
|---|---|---|---|---|
| 132,625 | A | 10/1872 | Browne | |
| 407,697 | A | 7/1889 | Sommer | |
| 796,725 | A | 8/1905 | Hordich | |
| 1,010,652 | A | 12/1911 | Locke | |
| 1,426,482 | A | 8/1922 | Koller | |
| 3,090,273 | A | 5/1963 | FOX | |
| 3,411,774 | A | 11/1968 | Thornton | |
| 3,818,194 | A | 6/1974 | Biro | |
| 3,983,647 | A | 10/1976 | Stubbmann | |
| 4,028,877 | A | 6/1977 | Vatterott | |
| 4,274,639 | A * | 6/1981 | Flanders | 273/402 |
| 4,308,880 | A | 1/1982 | Graves | |
| 4,323,233 | A | 4/1982 | Gebhard | |
| 4,391,064 | A | 7/1983 | Lakin et al. | |
| 4,664,640 | A | 5/1987 | Shindo et al. | |
| 5,147,236 | A | 9/1992 | Hartman | |
| 5,187,826 | A | 2/1993 | Mariol | |

(Continued)

FOREIGN PATENT DOCUMENTS

DE 3604232 A1 8/1987

(Continued)

*Primary Examiner* — Gene Kim
*Assistant Examiner* — Matthew B Stanczak
(74) *Attorney, Agent, or Firm* — Edell, Shapiro & Finnan, LLC

(57) ABSTRACT

A rotatable entertainment device includes a mobile arm rotatably coupled to the entertainment device, and a motion translation device coupled to the entertainment device and the mobile arm to convert an oscillatory motion of the entertainment device into a rotational motion of the mobile arm. The entertainment device is mountable to an oscillating device (e.g., a swing) that conveys the oscillatory motion from the oscillating device to the entertainment device.

15 Claims, 9 Drawing Sheets

U.S. PATENT DOCUMENTS

| | | | | |
|---|---|---|---|---|
| 5,377,433 | A | 1/1995 | Hazlehurst | |
| 5,451,095 | A * | 9/1995 | Riback | 297/354.12 |
| 5,509,721 | A | 4/1996 | Huang | |
| 5,820,060 | A | 10/1998 | Yano | |
| 5,887,945 | A | 3/1999 | Sedlack | |
| D461,854 | S | 8/2002 | Myers | |
| 6,464,594 | B1 | 10/2002 | Canna et al. | |
| 6,511,360 | B1 | 1/2003 | Lyman | |
| 6,572,483 | B1 | 6/2003 | Hoffman | |
| 6,592,425 | B2 | 7/2003 | Bapst et al. | |
| 6,629,727 | B2 | 10/2003 | Asbach et al. | |
| 6,705,950 | B2 | 3/2004 | Wood et al. | |
| 2002/0002741 | A1 * | 1/2002 | Tomas et al. | 5/101 |
| 2002/0094748 | A1 * | 7/2002 | Baik | 446/227 |

FOREIGN PATENT DOCUMENTS

| | | | |
|---|---|---|---|
| GB | 2213072 | A | 8/1989 |

* cited by examiner

ROTATABLE ENTERTAINMENT DEVICE

CROSS REFERENCE TO RELATED APPLICATIONS

This application claims priority from U.S. Provisional Patent Application Ser. No. 60/466,737, entitled "Rotatable Mobile Device", filed May 1, 2003, the disclosure of which is incorporated herein by reference in its entirety. This application is a continuation of and claims priority from copending U.S. patent application Ser. No. 10/691,663, filed Oct. 24, 2003.

BACKGROUND OF THE INVENTION

1. Field of the Invention

The present invention relates to toy entertainment devices, in particular, mobile toy devices that mount to a swing or other oscillating children's product.

2. Description of the Related Art

Children are interested in products that include movable mechanisms, such as rotatable mobile entertainment devices. In particular, rotatable mobiles are useful to keep a child occupied when the child is situated in a crib, bouncer, swing, or other similar child receiving device.

Many devices exist that may be mounted to an infant or child's swing, bouncer or other device to entertain the child. Such devices may further include rotatable elements to enhance the child's enjoyment when using the device. The rotatable elements typically require direct interaction by the child or an adult, such as rotation of the elements by hand or utilizing a wind-up mechanism. Alternatively, activation of the rotatable elements can be controlled electronically (e.g., via batteries) and a motor.

It would be desirable to provide a mobile or other rotatable entertainment device for a children's product that could rotate without the requirement of direct user or electronic interaction. In particular, it would be desirable to control rotary motion of the entertainment device in response to an oscillating motion of a children's product, such as a swing or a bouncer. Such indirect rotary motion would further enhance the entertainment value of the entertainment device for the child, as the rotation would appear to be magical and independent of any action performed by the child or parent.

Thus, there exists a need for providing a rotatable entertainment device that is mountable to a swing or other oscillating children's product, where the entertainment device is capable of rotating in response to oscillating movements of the children's product rather than by direct interaction by the user or other conventional electrical or mechanical drive mechanisms.

SUMMARY OF THE INVENTION

Therefore, in light of the above, and for other reasons that become apparent when the invention is fully described, an object of the present invention is to provide a rotary entertainment device that is configured for mounting to an oscillating children's product, such as a swing, a bouncer, or other oscillating product.

It is another object of the present invention to effect rotation of the entertainment device, when mounted to the oscillating children's product, without the requirement of direct user contact or interaction with the entertainment device.

It is a further object of the present invention to effect rotation of the entertainment device without the need for any electrical mechanisms (e.g., batteries or motors) or any mechanical mechanisms that require direct user manipulation (e.g., wind-up configurations) to achieve such rotation.

The aforesaid objects are achieved individually and in combination, and it is not intended that the present invention be construed as requiring two or more of the objects to be combined unless expressly required by the claims attached hereto.

In accordance with the present invention, a rotatable entertainment device includes a mobile arm rotatably coupled to the entertainment device, and a motion translation device coupled to the entertainment device and the mobile arm to convert an oscillatory motion of the entertainment device into a rotational motion of the mobile arm. The entertainment device is mountable to an oscillating children's product (e.g., a swing or bouncer) that conveys the oscillatory motion from the oscillating children's product to the entertainment device.

In a preferred embodiment, the motion translation device includes a gear assembly coupled to the mobile arm and the entertainment device, where the gear assembly effects rotational motion of the mobile arm in a single direction. An eccentrically weighted gear housing surrounds the gear assembly and rotates in response to oscillatory motion of the entertainment device. The rotational motion of the gear housing controls operation of the gear assembly to effect the rotational motion of the mobile arm.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

A rotary entertainment device for use with a children's swing or other oscillating children's product or device includes a mounting bar to secure the entertainment device to the oscillating product. The entertainment device further includes a mobile arm that is rotatably secured to the mounting bar and a gear housing that is rotatably mounted to the mounting bar and includes a gear assembly. The gear assembly is coupled to the mobile arm to effect rotary movement of the mobile arm with respect to the mounting bar in response to oscillating movement of the mounting bar as described below. Unless indicated otherwise, the mobile arm, mounting bar, gear housing and gear assembly are constructed of suitable materials (e.g., metals, plastics, etc.) that are preferably durable but of relatively light weight to enable use of the entertainment device with a number of different types of swings, bouncers, or other oscillating children's products.

Referring to FIGS. 1-5, entertainment device 1 includes curved mounting bar 2 with end portions that attach to a swing or other oscillating children's product. Attached to mounting bar 2 are gear housing 10 and mobile arm 12. The end portions of the mounting bar 2 may include any suitable fasteners to facilitate connection of the mounting bar to the oscillating children's product. While the mounting bar 2 depicted in the figures has a generally U-shaped configuration, it is noted that the mounting bar may have any suitable geometric configuration (e.g., straight, S-shaped, V-shaped, circular or elliptical, etc.).

Figure 1:
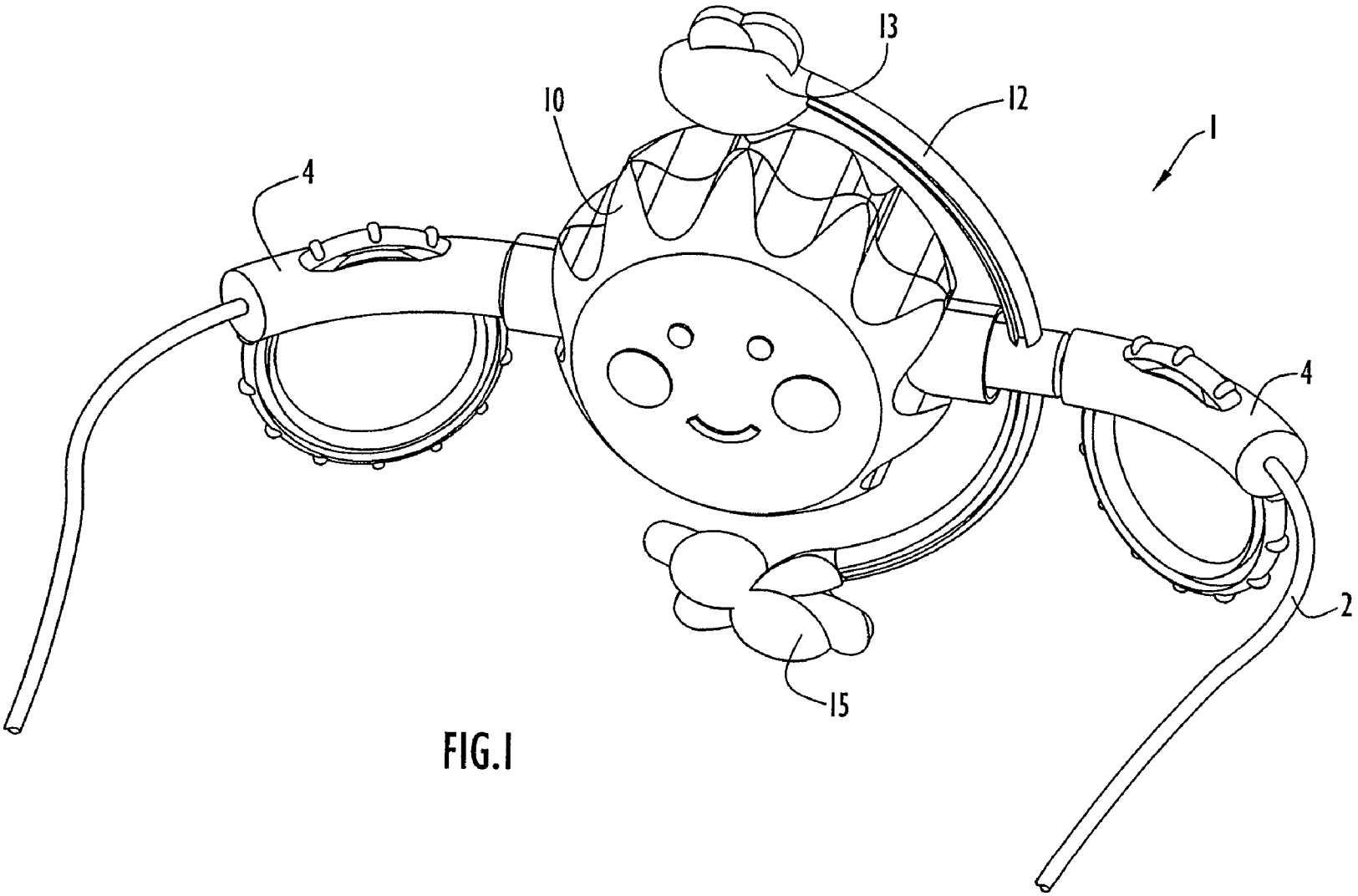
FIG. 1 is a perspective view of the operational components of a rotary entertainment device according to an embodiment of the present invention.

The mounting bar 2 can be connected to any suitable oscillating product including, without limitation, infant or child swings, bouncers, rocking chairs, rocking cribs and bassinets. In an exemplary embodiment depicted in FIG. 6, mounting bar 2 connects to the swing arm portions 102 of an electronic infant or child swing 100. The mounting bar 2 may be secured to the oscillating product in any suitable manner that facilitates oscillation of the mounting bar 2 in accordance with oscillating movements generated by the product to which the mounting bar 2 is secured. The mounting bar 2 may further include handles 4, as depicted in FIG. 1, to support ornamental and aesthetically pleasing objects for the child and/or for facilitating a gripping section for the child's hands.

Gear housing 10 is rotatably secured around a midsection of mounting bar 2, with the mounting bar 2 extending through openings disposed at opposing peripheral side sections of the gear housing 10. The gear housing 10 preferably has a geometric configuration and includes suitable ornamental features that are aesthetically pleasing to a child, such as the sun shape and printed indicia on gear housing 10 as depicted in FIG. 1. The gear housing 10 is separable into two half sections that are secured to each other in any suitable manner (e.g., via threaded screws). Enclosed and secured within gear housing 10 is a gear assembly that is coupled with mounting bar 2 as described below.

Figure 2:
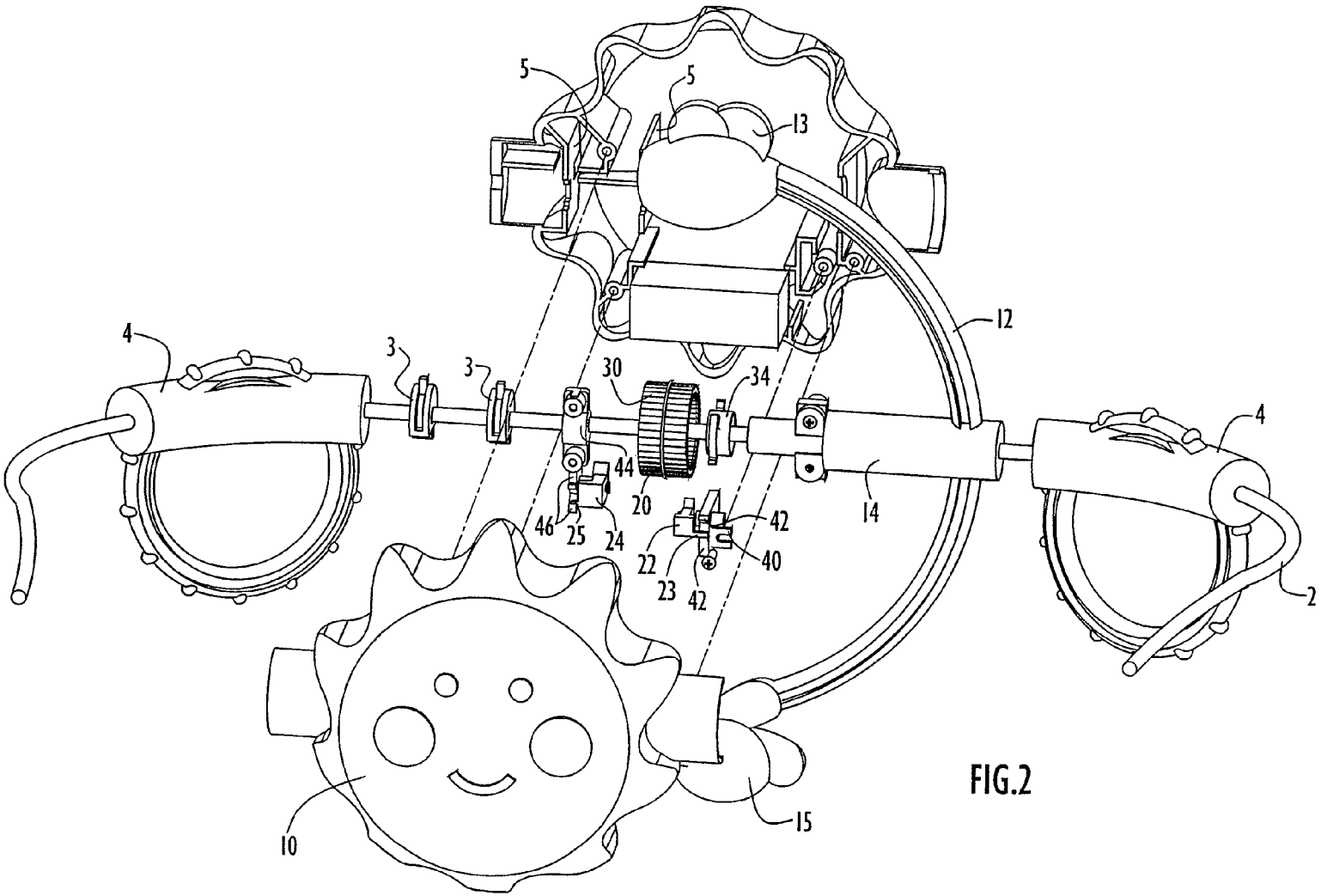
FIG. 2 is an exploded view in perspective of the embodiment of FIG. 1.
Figure 3:
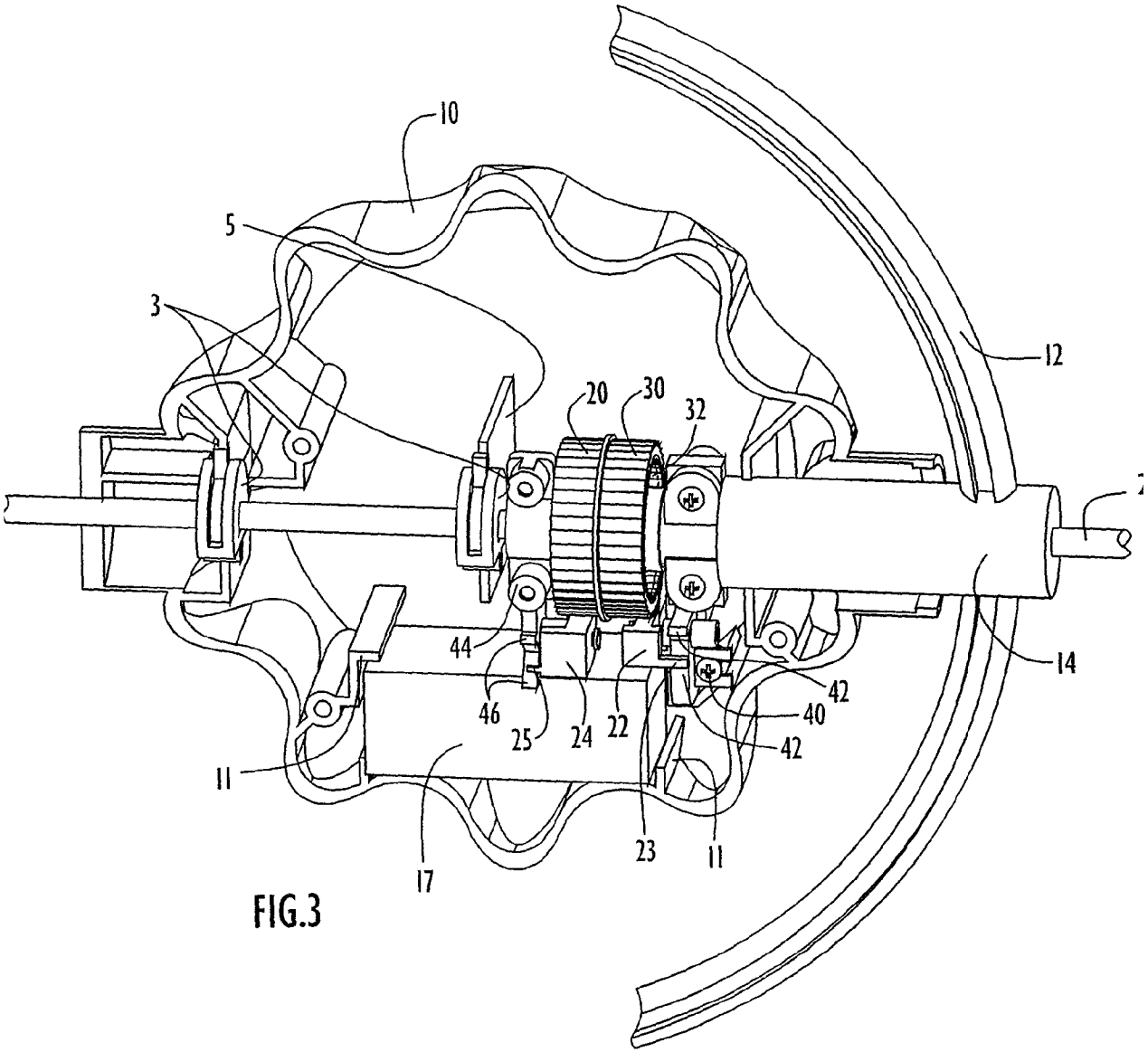
FIG. 3 is an enlarged and partial view of the embodiment of FIG. 1, including the gear housing in section.

Referring to FIGS. 2 and 3, spacers 3 are rotatably secured to mounting bar 2 and engage with corresponding ribs 5 within the gear housing 10 that are suitably distanced from portions of the gear assembly. In particular, spacers 3 are arranged within gear housing 10 to one side of the gear assembly components (i.e., to the left of the gear assembly components as viewed in FIGS. 2-4). The spacers 3 maintain a suitable spatial alignment and orientation between engaging components of the gear assembly and prevent or substantially limit movement of gear housing 10 with respect to the longitudinal axis of mounting bar 2 while permitting rotational movement of gear housing 10 with respect to the mounting bar 2.

Figure 7:
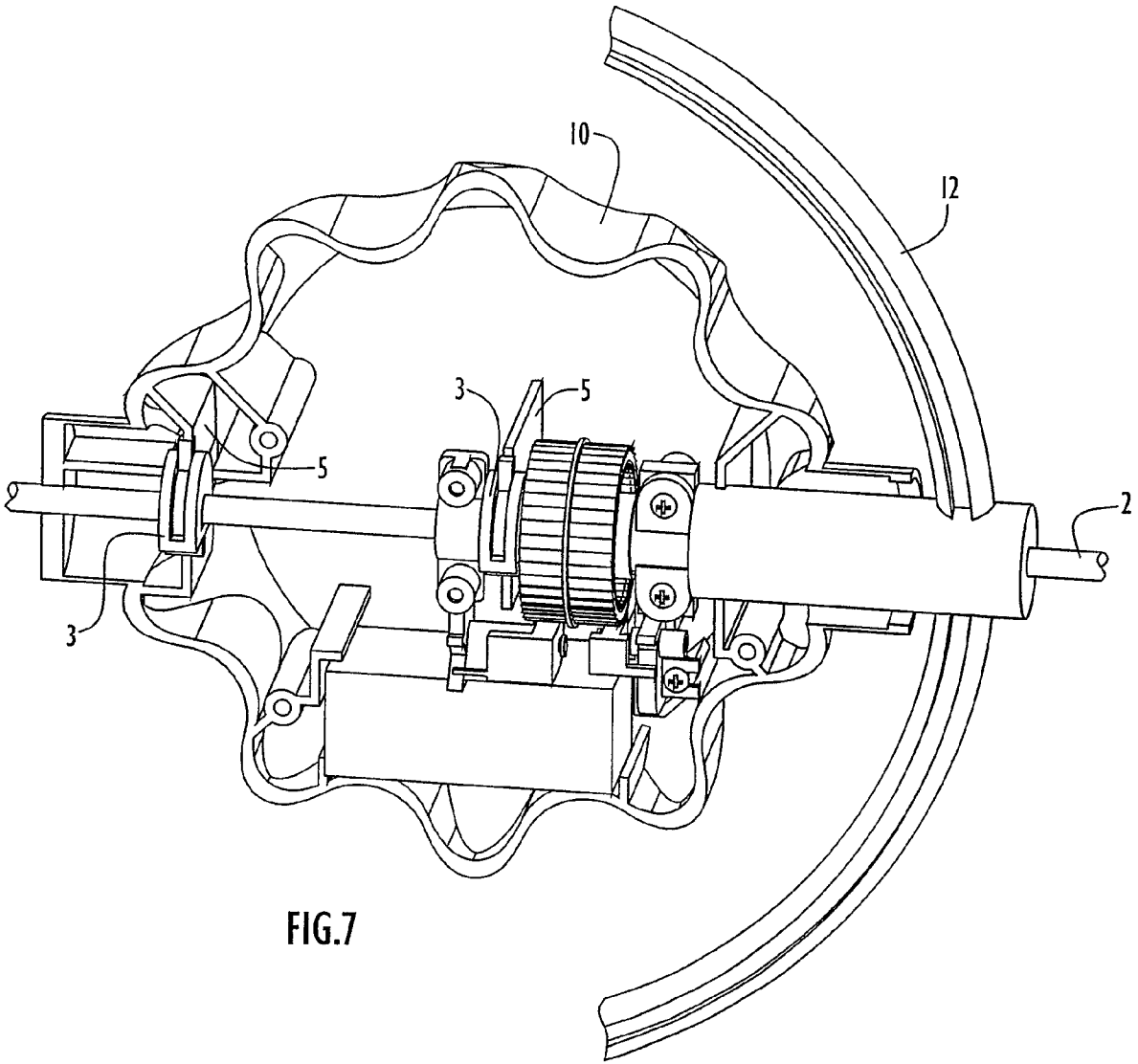
FIG. 7 is a perspective view in partial section of the operational components of a rotary entertainment device according to an alternative embodiment of the present invention.

While only two spacers 3 are depicted in FIGS. 1-5, it is noted that any suitable number of spacers and/or other engaging elements may be provided at any suitable locations within gear housing 10 to maintain a suitable orientation of the gear assembly within gear housing 10 and limit or substantially prevent movement of the gear housing 10 along the axis of mounting bar 2 while permitting rotational movement of gear housing 10 with respect to mounting bar 2. For example, in an alternative embodiment depicted in FIG. 7, spacers 3 are separated from each other along mounting bar 2 by certain gear components. However, the device of FIG. 7 functions in the same manner as the embodiment of FIGS. 1-5.

Gear housing 10 is eccentrically weighted to maintain gear housing 10 in a particular alignment with respect to mounting bar 2 during operation of the entertainment device 1. The term "eccentrically weighted", as used herein, refers to the weight or mass of an object being offset from its geometric center. Specifically, gear housing 10 includes counterweight 17 (shown in FIGS. 3, 4A, and 4B) that is secured between spatially oriented ribs 11 within a lower internal section of gear housing 10. Counterweight 17 may be constructed of any suitable material (e.g., steel, lead, or other metals) and has a sufficient mass to maintain gear housing 10 in a substantially vertical orientation with respect to mounting bar 2 when the mounting bar 2 is subjected to oscillating motion by the product to which it is attached. By maintaining gear housing 10 in a substantially vertical orientation, counterweight 17 imparts a rotation to gear housing 10 during oscillatory motion of mounting bar 2, which in turn effects operation of the gear assembly and a resultant rotational movement of mobile arm 12 about mounting bar 2 as described below.

Mobile arm 12 is rotatably secured to mounting bar 2 at a location proximate gear housing 10. In particular, mobile arm 12 extends transversely in two directions from mounting bar 2 and includes a cylindrical mobile arm mount 14 that secures mobile arm 12 to mounting bar 2. The particular mobile arm 12 depicted in FIGS. 1-5 has its mobile arm mount 14 disposed at a central location of mobile arm 12. However, it is noted that mobile arm mount 14 may include any geometric configuration (e.g., rectangular or multi-faceted) and may be located at any selected location along mobile arm 12. Mobile arm mount 14 extends around a portion of mounting bar 2 and into the opening disposed at one peripheral side section of gear housing 10 (i.e., at a location to the right of the gear assembly components as depicted in FIGS. 2-4). Mobile arm mount 14 is further rotatable with respect to each of mounting bar 2 and gear housing 10 and connects with the gear assembly within gear housing 10 in a manner described below.

Mobile arm 12 has a curved geometric configuration that bends and is concave in a direction facing gear housing 10, with ornamental and aesthetically pleasing objects secured at its terminal end portions. In the embodiment depicted in FIGS. 1-4, the ornamental objects include butterfly 15 and bee 13. However, it is noted that mobile arm 12 may have any suitable geometric configuration (e.g., linear, U-shaped, V-shaped, etc.) and extend in any selected orientation with respect to mounting bar 2 and gear housing 10, with any suitable number of objects of selected configurations secured at the ends and/or any other portions of mobile arm 12 to convey a particular motif or theme for the entertainment device 1. For example, in an alternative entertainment device embodiment illustrated in FIG. 8, entertainment device 200 includes mobile arm 212 with star-shaped objects 213 secured at its ends and gear housing 210 having a geometric configuration of a sun or moon around which star-shaped objects 213 orbit during rotation of mobile arm 212. The gear assembly components of entertainment device 200 are substantially similar to the gear assembly components of entertainment device 1.

Figure 4A:
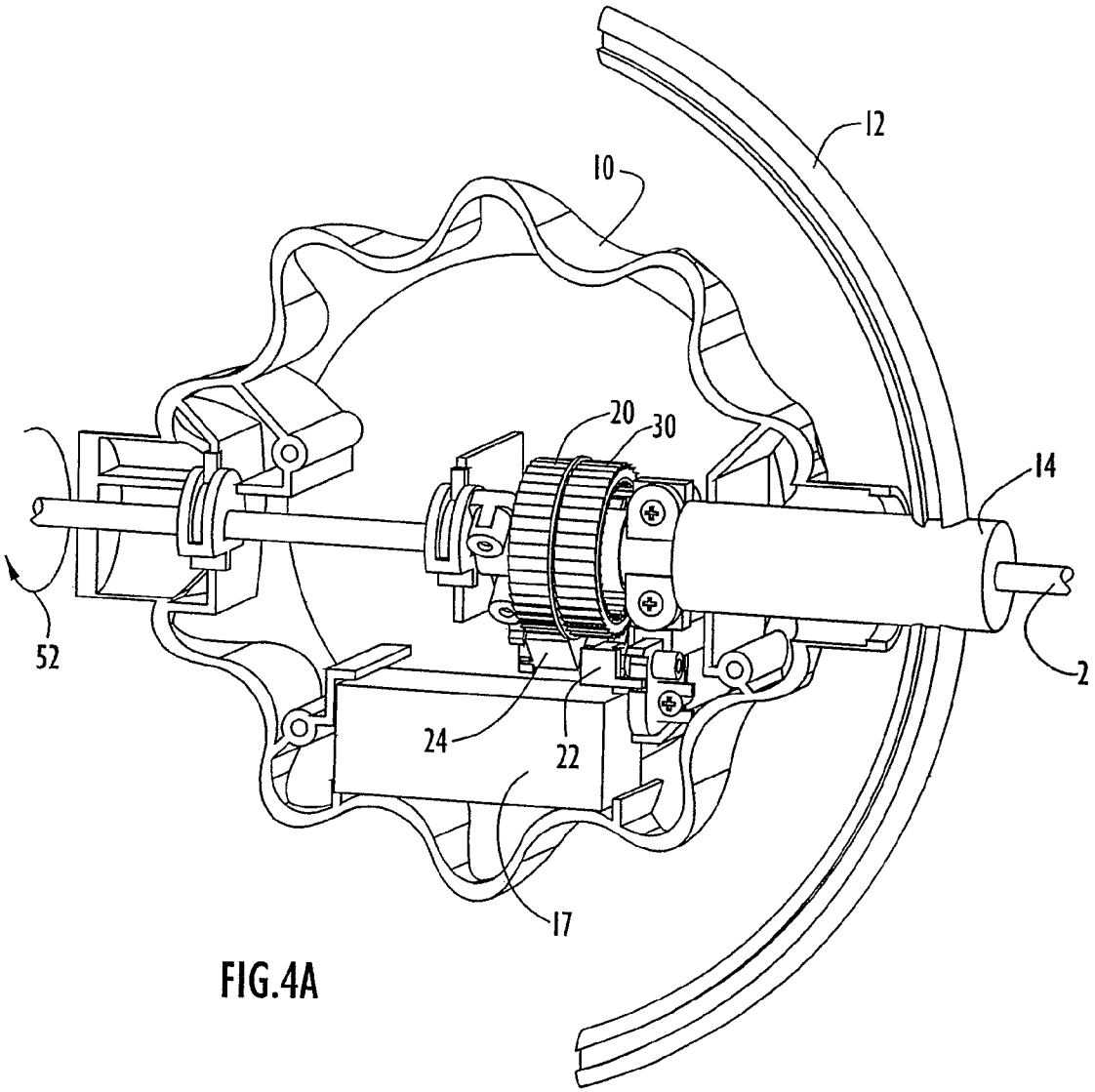
FIGS. 4A and 4B are enlarged and partial views of the embodiment of FIG. 1, including the gear housing in section.
Figure 4B:
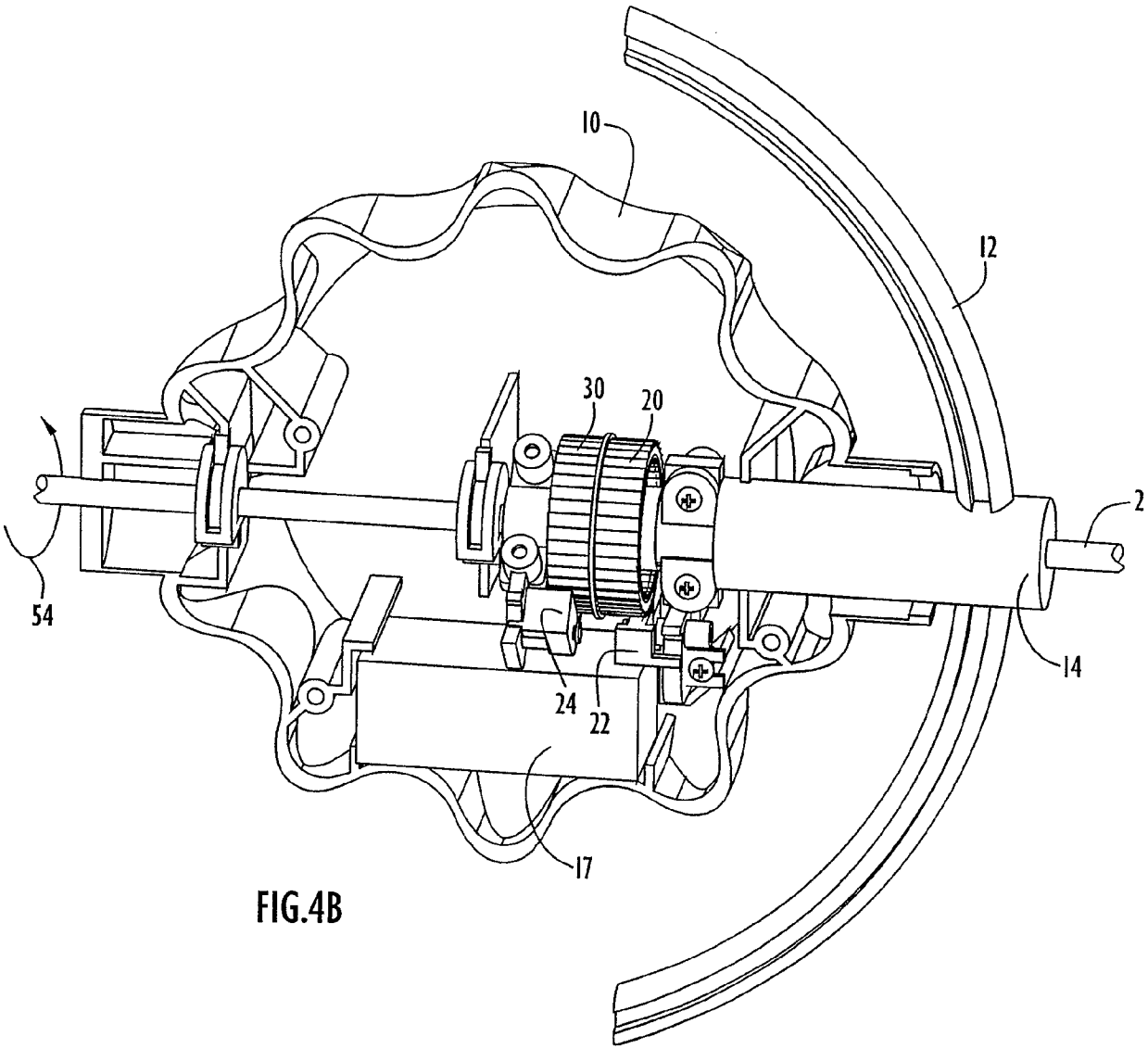
Figure 5:
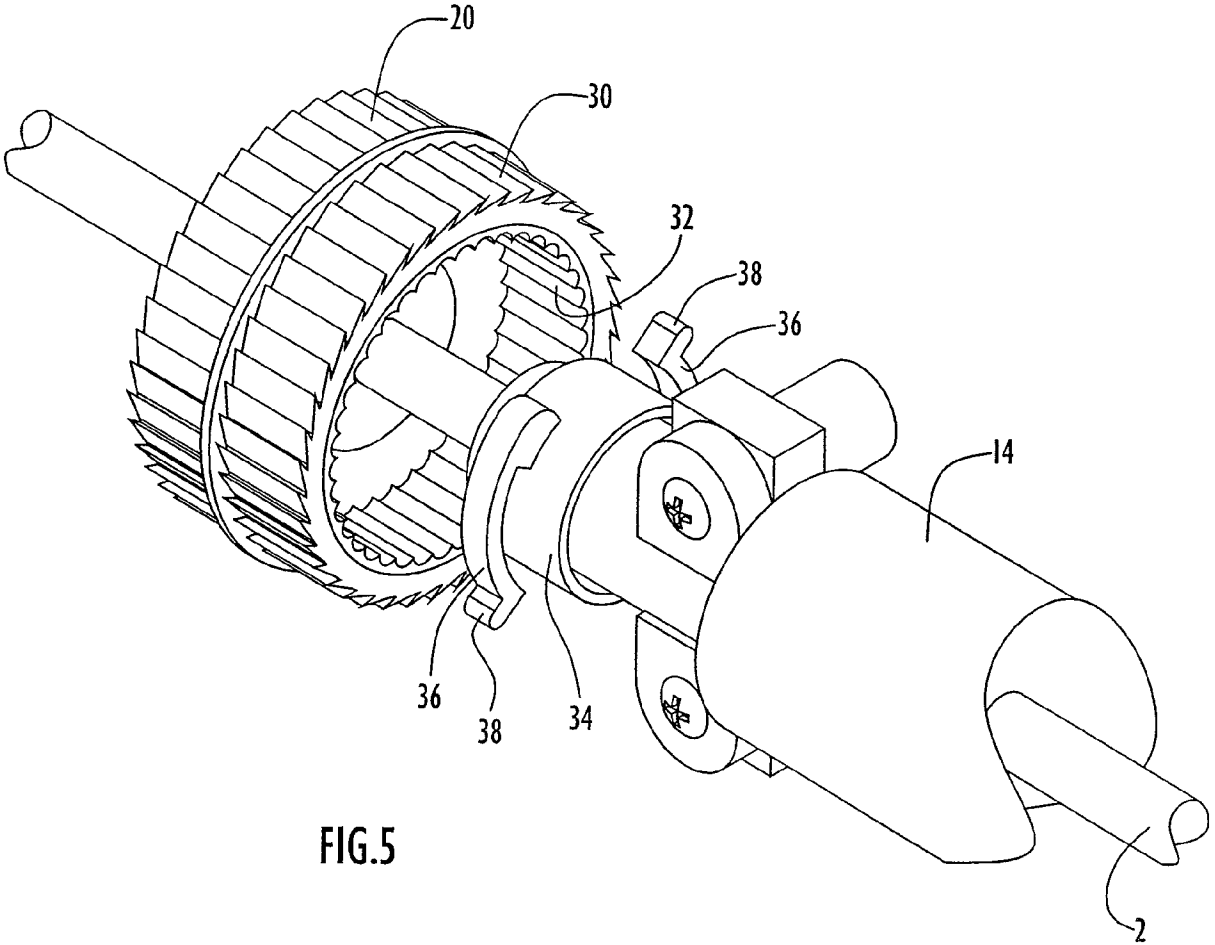
FIG. 5 is an enlarged view in perspective of a portion of the mounting bar, the ratchet gear and the clutch mechanism of FIGS. 4A and 4B.

The gear assembly within gear housing 10 is designed to effect rotation of mobile arm 12 in a single direction with respect to mounting bar 2 when mounting bar 2 oscillates along with the swing or other product to which it is secured. Referring to FIGS. 2-5, the gear assembly includes ratchet gear 20 that is rotatably secured around the portion of mounting bar 2 extending into and through gear housing 10. Ratchet gear 20 is further coupled to an adjacent end of mobile arm mount 14 that extends into the gear housing 10. Ratchet gear 20 includes a first set of teeth 30 disposed along the external periphery of ratchet gear 20 to engage with pawls of the gear assembly that are secured within housing 10 in a manner described below. As shown in FIGS. 3 and 5, ratchet gear 20 further includes a partially hollow interior with second set of teeth 32 disposed along an interior surface of ratchet gear 20. Internal teeth 32 of ratchet gear 20 extend in an opposing direction in relation to external teeth 30 and engage with portions of a clutch device secured to mobile arm mount 14 of mobile arm 12 in a manner described below.

The gear assembly further includes a pair of pawls that releasably and independently engage with ratchet gear 20 to effect rotational movement of mobile arm 12. Specifically, eccentrically weighted first pawl 22 is secured within gear housing 10 via first pawl support structure 40 and at a suitable location proximate counterweight 17 to permit first pawl 22 to engage with external teeth 30 of ratchet gear 20. First pawl 22 is rotatably secured to support structure 40 and includes pin 23 that extends from a side section of first pawl 22 into a gap defined between two vertically aligned fingers 42 that extend from support structure 40. Pin 23 limits the degree of rotational movement of the first pawl with respect to first pawl support structure 40. The eccentric weight of first pawl 22 orients first pawl 22 into an engaging position with external teeth 30 of ratchet gear 20, where pin 23 engages the lower finger 42 of support structure 40. However, first pawl 22 may be disengaged from ratchet gear 20 during certain rotation of gear housing 10 and/or mobile arm 12, which in turn causes first pawl 22 to rotate and pin 23 to move within the gap between fingers 42 of support structure 40.

An eccentrically weighted second pawl 24 is connected to and extends from the portion of mounting bar 2 disposed within gear housing 10 so as to releasably engage with external teeth 30 of ratchet gear 20. Second pawl 24 is rotatably secured to support structure 44 that extends from and is rigidly (i.e., non-rotatably) secured to mounting bar 2. A pin 25 extends from a side section of second pawl 24 into a gap defined between two spatially aligned fingers 46 that extend from support structure 44. Pin 25 limits the degree of rotational movement of second pawl 24 with respect to second pawl support structure 44 in a similar manner as described above for first pawl 22. Specifically, the eccentric weighting of second pawl 24 orients second pawl 24 into an engaging position with external teeth 30 of ratchet gear 20, where pin 25 engages the lower finger 46 of support structure 44. However, second pawl 24 may be disengaged from ratchet gear 20 during certain rotation of gear housing 10 and/or mobile arm 12, which in turn causes second pawl 24 to rotate and pin 25 to move within the gap between fingers 46 of support structure 44.

The first and second pawls are designed to releasably engage with external teeth 30 of ratchet gear 20 so as to control the rotation of ratchet gear 20 in a single direction. During all phases of oscillating movement of mounting bar 2, counterweight 17 substantially maintains gear housing 10 and first pawl 22 in a generally vertical orientation with respect to mounting bar 2, while second pawl 24 moves with mounting bar 2 as mounting bar 2 oscillates. During oscillating movement of mounting bar 2, first and second pawls 22, 24 move in opposing directions with respect to each other between positions in which first and second pawls 22, 24 are generally vertically aligned with each other (e.g., as depicted in FIG. 3) to positions in which first and second pawls 22, 24 are offset from each other (e.g., as depicted in FIGS. 4A and 4B). The offset positions of first and second pawls 22, 24 depicted in FIGS. 4A and 4B is dependent upon the oscillatory motion of mounting bar 2 and corresponding rotational direction of gear housing 10 with respect to mounting bar 2 (as shown by rotational arrow 52 in FIG. 4A and rotational arrow 54 in FIG. 4B).

When mounting bar 2 oscillates with the oscillating product to which it is attached in a first oscillatory direction (e.g., a forward swing), gear housing 10 rotates in an opposing first rotational direction (e.g., in the rotational direction indicated by arrow 52 in FIG. 4A) with respect to mounting bar 2 to achieve and maintain a substantially vertical orientation of gear housing 10 due to counterweight 17 being disposed within the lower section of gear housing 10. First pawl 22 disengages and ratchets along external teeth 30 of ratchet gear 20 during rotation of gear housing 10 in the first rotational direction 52, while second pawl 24 moves with mounting bar 2 and maintains engagement with ratchet gear 20 to prevent ratchet gear 20, and thus mobile arm 12, from rotating in the first rotational direction.

When mounting bar 2 oscillates with the oscillating product to which it is attached in a second oscillating direction that opposes the first oscillating direction (e.g., a reverse swing), gear housing 10 rotates in an opposing second rotational direction (e.g., in the rotational direction indicated by arrow 54 in FIG. 4B) with respect to mounting bar 2 to once again establish a substantially vertical orientation of gear housing 10. In this rotational movement, first pawl 22 remains engaged with ratchet gear 20 to force ratchet gear 20, and thus mobile arm 12, to rotate with respect to mounting bar 2 in the second rotational direction (i.e., the direction in which gear housing 10 rotates to achieve its substantial vertical orientation). At the same time, second pawl 24 moves with mounting bar 2 and disengages with and ratchets along external teeth 30 to permit movement of ratchet gear 20 by first pawl 22 in the second rotational direction.

The results of the present invention is that the oscillating movement of mounting bar 2 results in opposite engaging and disengaging interactions of first and second pawls 22, 24, which in turn forces a rotational movement of mobile arm 12 in incremental amounts by ratchet gear 20 in a single direction while preventing or substantially limiting slipping or other rotational movement in an opposing direction. The first pawl 22 essentially serves as a driving pawl to drive ratchet gear 20 and mobile arm 12 during certain oscillatory movement of mounting bar 2, whereas second pawl 24 essentially serves to hold and prevent rotational movement of ratchet gear 20 during disengagement and ratcheting of first pawl 22 with respect to ratchet gear 20.

Entertainment device 1 further includes a clutch to disengage mobile arm 12 from ratchet gear 20 when a sufficient force is applied to mobile arm 12 in a direction opposing the rotational movement imparted to mobile arm 12 by the gear assembly. Referring to FIG. 5, the clutch includes ratchet disk 34 that is secured at one end of mobile arm mount 14 and extends within the hollow interior of ratchet gear 20. Two ratchet arms 36 extend transversely from and at opposing locations along ratchet disk 34. Each ratchet arm 36 further extends along a circumferential portion of ratchet disk 34 and includes a pawl 38 located at a terminal end of ratchet arm 36. Each pawl 38 extends toward and engages with internal teeth 32 of ratchet gear 20. Pawls 38 are cantilevered with respect to ratchet disk 34 and are deflectable toward and away from ratchet gear 20 so as to disengage and ratchet along internal teeth 32 of ratchet gear 20 when mobile arm 12 is held in a fixed position or rotated in a direction that opposes the rotational movement imparted by the gear assembly upon mobile arm 12 (i.e., the second rotational direction as described above and shown by rotational arrow 54 of FIG. 4B).

Thus, when gear housing 10 rotates back and forth in the first and second rotational directions in response to corresponding oscillation of mounting bar 2, pawls 38 of ratchet disk 34 remain engaged with internal teeth 32 of ratchet gear 20 so as to effect rotation of mobile arm 12 in response to rotations imparted to ratchet gear 20. However, when a sufficient force is applied to mobile arm 12 that opposes the rotational force acting on mobile arm 12 by the gear assembly, pawls 38 are deflected away from and ratchet along internal teeth 32 of ratchet gear 20 to disengage mobile arm mount 14 from ratchet gear 20.

Thus, the clutch design of entertainment device 1 permits mobile arm 12 to safely disengage from the gear assembly to prevent damage to the gear assembly of the entertainment device and/or harm to the user in the event the user of the entertainment device grabs hold and/or pushes or pulls mobile arm 12 in a particular direction (e.g., a direction counter the driving rotational direction of mobile arm 12). It is noted that the clutch design of the present invention is not limited to the specific ratchet disk 34 and ratchet arm 36 arrangement described above. Rather, any suitable clutch mechanism may be utilized to effect selective disengagement of mobile arm 12 from the gear assembly.

The gear assembly design described above also permits the user to independently rotate mobile arm 12 in the direction that the gear assembly drives mobile arm 12 without damaging the gear assembly. For example, if a sufficient rotational force is applied by the user to mobile arm 12 in the rotational driving direction of the gear assembly (i.e., the second rotational direction described above), both first and second pawls 22, 24 will disengage to allow ratchet gear 20 to move or "free wheel" with respect to first and second pawls 22, 24.

Figure 6:
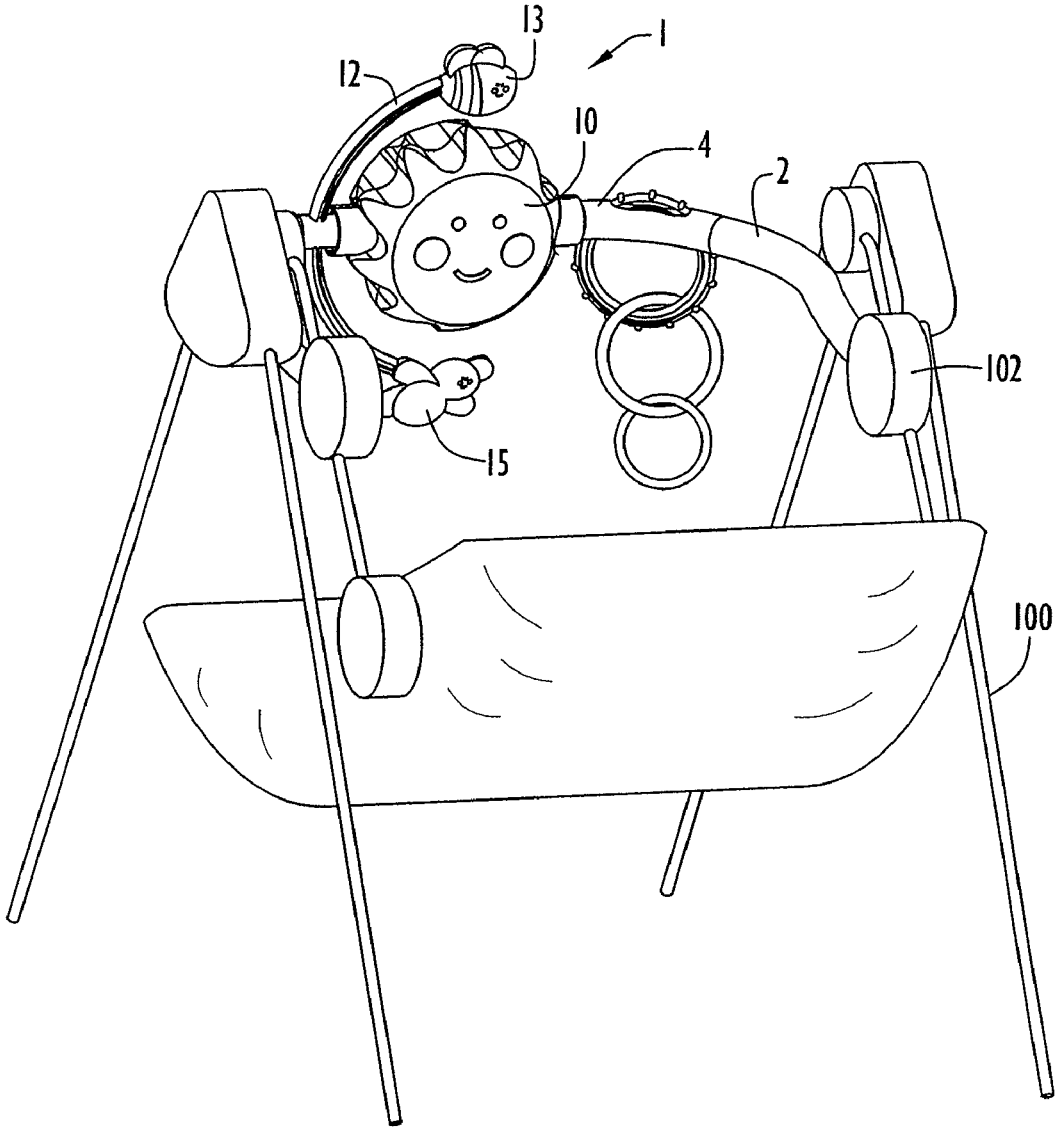
FIG. 6 is a children's swing product employing a rotary entertainment device in accordance with the present invention.

Operation of entertainment device 1 will now be described with reference to FIGS. 1-6. Initially, if entertainment device 1 is not secured to an oscillating device, the terminal ends of mounting bar 2 are secured to the oscillating device in a suitable manner. For example, the entertainment device 1 may be secured to upper portions of swing arms 102 of an electronic infant swing product 100 as generally depicted in FIG. 6. The gear assembly of the entertainment device 1 is actuated when the swing is oscillated in forward and reverse directions. The forward and reverse oscillations of the swing cause gear housing 10 to rotate in opposing directions, due to counterweight 17 disposed within gear housing 10, to maintain gear housing 10 in a generally vertical orientation with respect to mounting bar 2 and swing product 100. The rotation of gear housing 10 actuates the gear assembly within gear housing 10 to effect rotational movement of mobile arm 12 in a single direction (i.e., the second rotational direction as described above) with respect to mounting bar 2. The gear assembly further prevents mobile arm 12 from slipping or rotating in a direction counter to the driving rotational movement of mobile arm 12 during normal operation of the device 1.

Thus, the entertainment device 1 translates the oscillating motion of mounting bar 2 to rotational movement of mobile arm 12 with respect to mounting arm 2, resulting in a "magical" effect of mobile arm 12 moving without the requirement of user-actuated electrical or mechanical wind-up components for the entertainment device 1. In addition, the clutch design of the entertainment device 1 allows mobile arm 12 to safely disengage from the gear assembly if a child or other user of the entertainment device 1 chooses to grab hold of and/or move mobile arm 12 in a direction that opposes the rotational movement imparted to mobile arm 12 by the gear assembly. The gear assembly design further permits enhanced rotational movement or "free wheeling" of mobile arm 12 by the user.

Figure 8:
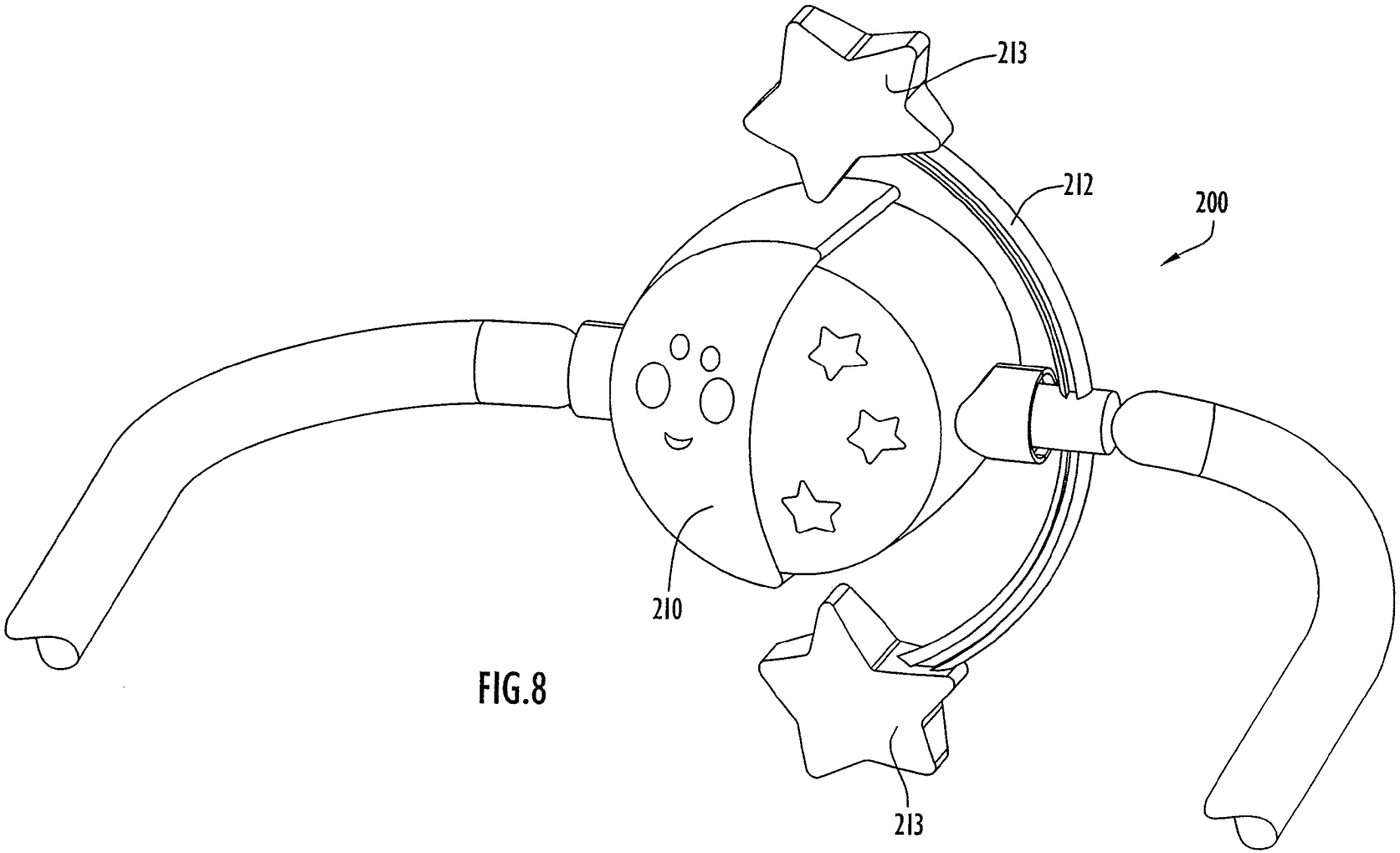
FIG. 8 is a perspective view of a rotary entertainment device according to a further embodiment of the present invention.

A further feature may be provided to the entertainment device of the present invention in order to enhance the rotational movement of mobile arm 12 during use. Specifically, the objects 13, 15 secured at the end portions of mobile arm 12 may be weighted differently with respect to each other to permit an almost continuous rotation of mobile arm 12 in the driving rotational direction (i.e., the second rotational direction imparted to the mobile arm by the gear assembly as described above). When the heavier object 13, 15 reaches its maximum vertical orientation in its rotational orbit or trajectory around mounting bar 2, the torque applied by the heavier object to mobile arm 12 and ratchet gear 20 (i.e., due to gravitational forces and the "free fall" of the heavier object) will cause mobile arm 12 and ratchet gear 20 to rotate or "free wheel" in the second rotational direction, regardless of the oscillating movements of the mounting bar. During this rotation, first and second pawls 22, 24 disengage and ratchet along external teeth 30 of ratchet gear 20. Mobile arm 12 continues to rotate in the second rotational direction until the "free fall" of the heavier object is substantially complete and/or opposing gravitational forces begin to act on the heavier object (i.e., the heavier object has substantially completed its vertical descent and/or has started its vertical ascent). At this point, "free wheeling" of mobile arm 12 is halted due to the engagement of first and second pawls 22, 24 with external teeth 30 of ratchet gear 20, and the gear assembly continues to operate in its normal manner (i.e., in the manner described above). This feature can be aesthetically pleasing to the child or other user, particularly if objects are shaped in a manner to enhance this rotational effect (e.g., when the gear housing and mobile arm objects have a moon and stars configuration as depicted in FIG. 8).

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

We claim:

1. An oscillating product that includes a portion for receiving a person and further includes an entertainment device, the entertainment device comprising:

a mobile arm rotatably coupled to the entertainment device, the mobile arm including at least one terminal end;

a motion conversion device coupled to the entertainment device and the mobile arm to convert an oscillatory motion of the entertainment device into a rotational motion of the mobile arm such that the at least one terminal end of the mobile arm rotates in a path that extends around at least a portion of the entertainment device, wherein the path defines a two-dimensional plane extending inward from and including all points on the path, the two-dimensional plane intersecting the portion of the entertainment device around which the mobile arm rotates; and a mounting member to secure the entertainment device to the oscillating product;

wherein, upon securing the mounting member to the oscillating product, the oscillating product conveys the oscillatory motion to the entertainment device.

2. The oscillating product of claim 1, wherein the motion conversion device comprises a weighted housing and a gear assembly, the weighted housing is configured to rotate in response to oscillatory motion of the entertainment device and the gear assembly is configured to effect rotational motion of the mobile arm in response to rotational motion of the weighted housing such that oscillatory motion of the entertainment device is converted into rotational motion of the mobile arm.

3. The oscillating product of claim 2, wherein at least a portion of the gear assembly is disposed within the weighted housing.

4. The oscillating product of claim 2, wherein the gear assembly includes a ratchet gear coupled to the mobile arm and a driving pawl that is secured to and rotates with the weighted housing and releasably engages the ratchet gear to effect rotational motion of the ratchet gear and the mobile arm.

5. The oscillating product of claim 4, wherein the gear assembly further includes a second pawl to prevent the gear assembly from rotating the mobile arm in a direction opposite the single rotational direction.

6. The oscillating product of claim 5, wherein the driving pawl and the second pawl move in opposing directions with respect to each other during oscillatory motion of the entertainment device.

7. The oscillating product of claim 2, further comprising:

a clutch releasably coupling the mobile arm with the gear assembly to disengage the mobile arm from the gear assembly upon application of a force to the mobile arm that opposes rotational motion of the mobile arm in the single direction.

8. The oscillating product of claim 1, wherein the mounting member includes at least one fastener to connect the entertainment device to the oscillating product.

9. The oscillating product of claim 1, wherein the mobile arm includes at least one object secured along the mobile arm.

10. The oscillating product of claim 9, wherein the at least one terminal end of the mobile arm includes a first terminal end and a second terminal end, the mobile arm also including a first object secured proximate the first terminal end of the mobile arm and a second object secured proximate the second terminal end of the mobile arm.

11. The oscillating product of claim 10, wherein the first object is heavier than the second object.

12. The oscillating product of claim 1, wherein the oscillating product comprises a swing.

13. An oscillating product that includes a portion for receiving a person and further includes an entertainment device, the entertainment device comprising:

a mobile arm rotatably coupled to the entertainment device, the mobile arm including at least one terminal end;

a means for mounting the entertainment device to the oscillating product such that an oscillating movement of the oscillating product is translated to an oscillatory motion of the entertainment device; and a means for converting oscillatory motion of the entertainment device into a rotational motion of the mobile arm such that the at least one terminal end of the mobile arm rotates in a path that extends around at least a portion of the entertainment device in response to oscillatory motion of the entertainment device, wherein the path defines a two-dimensional plane extending inward from and including all points on the path, the two-dimensional plane intersecting the portion of the entertainment device around which the mobile arm rotates.

14. A method of rotating a mobile arm, including at least one terminal end, coupled to an entertainment device, comprising the steps of:

providing a mounting member to facilitate mounting of the entertainment device to an oscillating product;

imparting oscillatory movement to the entertainment device; and providing a motion conversion device that is coupled to the entertainment device and the mobile arm, wherein the at least one terminal end of the mobile arm rotates in a path that extends around at least a portion of the entertainment device in response to oscillatory movement of the entertainment device, wherein the path defines a two-dimensional plane extending inward from and including all points on the path, the two-dimensional plane intersecting the portion of the entertainment device around which the mobile arm rotates.

15. The method of claim 14, wherein the motion conversion device comprises a weighted housing and a gear assembly, the weighted housing rotates in response oscillating movement of the entertainment device, and the gear assembly effects rotational motion of the mobile arm in response to rotational motion of the weighted housing such that oscillatory motion of the entertainment device is converted into rotational motion of the mobile arm.

* * * * *